United States Patent [19]

Ford et al.

[11] 4,207,193

[45] Jun. 10, 1980

[54] METHODS AND COMPOSITIONS FOR REMOVING ASPHALTENIC AND PARAFFINIC CONTAINING DEPOSITS

[75] Inventors: William G. F. Ford; Tommy R. Gardner, both of Duncan, Okla.

[73] Assignee: Halliburton Company, Duncan, Okla.

[21] Appl. No.: 889,694

[22] Filed: Mar. 24, 1978

[51] Int. Cl.[2] ..... E21B 43/25; E21B 43/28

[52] U.S. Cl. ..... 252/8.55 B; 134/40; 166/304; 252/8.55 C

[58] Field of Search ..... 252/8.55 B, 8.55 C; 166/304; 134/40

[56] References Cited

U.S. PATENT DOCUMENTS

| | | | |
|---|---|---|---|
| 2,124,530 | 7/1938 | Loomis et al. | 252/8.55 |
| 2,356,205 | 8/1944 | Blair et al. | 252/8.55 |
| 3,241,614 | 3/1966 | Bertness | 166/304 |
| 3,279,541 | 10/1966 | Knox et al. | 252/8.55 |
| 3,395,757 | 8/1968 | Crossland | 252/8.55 X |
| 3,402,770 | 9/1968 | Messenger | 252/8.55 X |
| 3,481,870 | 12/1969 | Cheng et al. | 252/8.3 |
| 3,794,523 | 2/1974 | Thompson | 252/8.55 X |
| 3,914,132 | 10/1975 | Sutton | 134/40 |

*Primary Examiner*—Herbert B. Guynn

*Attorney, Agent, or Firm*—Thomas R. Weaver; J. H. Tregoning; C. Clark Dougherty, Jr.

[57] ABSTRACT

Asphaltenic and paraffinic containing deposits are removed by contacting the deposits with an aqueous dispersion of a hydrocarbon solvent, an amine and a nonionic alkylated aryl polyether alcohol.

19 Claims, No Drawings

METHODS AND COMPOSITIONS FOR REMOVING ASPHALTENIC AND PARAFFINIC CONTAINING DEPOSITS

The deposition and accumulation of solid materials in oil and gas well producing formations, tubular goods, production and storage equipment, pipelines and crude oil processing equipment have long been a source of trouble and operating expense to petroleum producers and processors. Such deposits can include inorganic constituents such as calcium carbonate, iron oxide and iron sulfide scales as well as organic constituents such as asphaltenes, paraffins, tars, heavy oils, greases and the like. In some petroleum producing areas, deposits containing both asphaltenic and paraffinic compounds build up on the faces of producing formations as well as in tubular goods, production equipment and related apparatus whereby production is decreased requiring frequent and expensive remedial procedures.

Various methods and techniques have heretofore been utilized for removing deposits derived from crude oil including dissolving the deposits in hot crude oil, diesel oil, kerosene and other hydrocarbon solvents and the use of mechanical apparatus for scraping the surfaces containing such deposits. While these methods and techniques have achieved some success, they are generally expensive to carry out and often achieve less than desired results.

More recently, improved solvents and compositions have been developed and used successively in the removal of organic deposits. For example, in U.S. Pat. No. 3,241,614, a process for cleaning a well bore containing deposits of heavy hydrocarbons such as paraffins is disclosed. In accordance with the process, paraffinic deposits are contacted with a liquid mixture comprised of a solvent for the paraffinic hydrocarbons, e.g., kerosene, and a surfactant, e.g., an oxyethylene ether of an alkyl aryl compound. The mixture displaces water films on the depsoits and penetrates heavy hydrocarbons which are emulsified with water. The penetration of the deposits by the solvent preconditions the deposits, i.e., softens them whereby when the deposits are contacted with water in a second step of the process, the hydrocarbons become dispersed in the water. It is also disclosed that the mixture of solvent for hydrocarbons and surfactant can be combined with water and injected into a wall bore to remove paraffinic deposits.

While the process and compositions disclosed in the above-mentioned patent are effective for removing organic deposits which are paraffinic in nature, they are relatively ineffective for dissolving asphaltenic compounds. In general, organic deposits of high asphaltenic content are hard and brittle while deposits formed primarily of paraffinic compounds are soft and pliable. Thus, deposits containing asphaltenic compounds have been particularly troublesome in that they are difficult to remove by mechanical methods and conventional solvents are relatvely ineffective. A recently developed process and composition for removing asphaltenic deposits is disclosed in U.S. Pat. No. 3,914,132. The process comprises dissolving the deposits in a solvent comprised of an aromatic hydrocarbon and an amine, e.g., ethylenediamine, in particular amounts of each. While the solvent is particularly effective for dissolving asphaltenic compounds, it is relatively ineffective in dissolving paraffinic compounds which may also be contained in the deposits to be removed. Thus, heretofore, the removal or organic deposits containing both paraffinic and asphaltenic compounds has required a treatment including a minimum of two steps. In the first step, paraffinic compounds contained in the deposits are dissolved and/or dispersed in a first composition followed by the dissolution of the asphaltenic compounds by a second composition in a second step, or vice versa.

By the present invention methods and compositions for removing asphaltenic and paraffinic containing deposits in a single treatment are provided which are more effective and economical than the heretofore used methods and compositions.

In accordance with the present invention, surfaces containing deposits including asphaltenic and paraffinic compounds are contacted with an aqueous composition which strips the deposits from the surfaces in finely divided particles and suspends the particles therein whereby redeposition of the deposits does not occur. If the deposits include inorganic scale such as calcium carbonate, iron oxides, iron sulfides and the like, the aqueous composition can include an acid or mixture of acids to simultaneously remove the scale along with the organic components.

The aqueous composition of the present invention for removing asphaltenic and paraffinic containing deposits is comprised of an aqueous carrier liquid having dispersed therein a hydrocarbon solvent, a base selected from ammonium hydroxide, organic bases and acidic salts thereof and mixtures thereof wherein said organic bases are selected from the group consisting of pyridine, morpholine and primary, secondary and tertiary amines defined by the general formula:

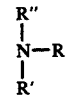

wherein R, R' and R'' represent members selected from the group consisting of hydrogen, alkyl radicals having 1 to 4 carbon atoms, alkyl amine radicals having from 1 to 4 carbon atoms, cycloalkyl radicals having 3 to 6 carbon atoms and mixtures thereof, and a surfactant, preferably a nonionic alkylated aryl polyether alcohol.

Base materials of the type defined above which are preferred for use herein are organic bases having no more than 2 nitrogen atoms per molecule. Compounds which are within the scope of the above formula having more than 1 nitrogen atom per molecule are those which do not include direct nitrogen-to-nitrogen bonding. Examples of organic bases which are particularly useful in accordance with the present invention are pyridine, morpholine and low molecular weight primary, secondary and tertiary amines such as n-butyl amine, ethylenediamine, diethylenetriamine, dimethylaminopropylamine, diethylaminopropylamine and cycloalkylamines such as cyclohexylamine.

Base concentrations in the range of from about 0.04% by weight to about 2.5% by weight of the aqueous composition are effective in enhancing the removal of asphaltenic compounds by the composition. Preferably, the amine is selected from the group consisting of n-butyl amine, ethylenediamine, diethylenetriamine and mixtures thereof and is present in the composition in an amount in the range of from about 0.1% by weight to about 0.5% by weight. Most preferably, the amine is ethylenediamine present in the composition in an amount of about 0.25% by weight.

Examples of hydrocarbon solvents which are particularly useful in accordance with the present invention are benzene, xylene, toluene, naphtha, kerosene and mixtures of such hydrocarbons. The hydrocarbon solvents or mixture thereof can be included in the aqueous composition in an amount in the range of from about 3% by weight to about 9% by weight, and preferably, in an amount of about 7% by weight to about 8.5% by weight. Most preferably, the hydrocarbon solvent is xylene, or a mixture of xylene and toluene present in the composition in an amount of about 8% by weight.

The surfactants which are useful in accordance with this invention are those which function as a dispersant and have solubility in both hydrocarbons and water. That is, the surfactant must be capable of dissolving to some extent in either water or hydrocarbons. Preferred such surfactants are those defined by the general formula:

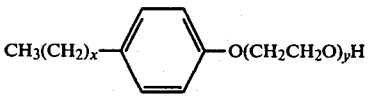

wherein x has a value ranging from about 2 to about 11 and y has a value ranging from about 10 to about 40.

The alkyl aryl portion of the surfactant, i.e., the hydrocarbon soluble portion, can thus contain from about 9 to about 18 carbon atoms. The oxyethylene portion of the compound, i.e., the water soluble portion, can contain from about 10 to about 40 moles of ethylene oxide. Of the various surfactants within the scope of the above formula, ethoxylated nonylphenol having an ethylene oxide content of from about 10 to about 40 moles and ethoxylated octylphenol having an ethylene oxide content of from about 10 to about 40 moles are preferred. The surfactant is included in the aqueous composition of the invention in an amount in the range of from about 0.04% by weight to about 4% by weight, and more preferably, in an amount in the range of from about 0.2% by weight to about 1.5% by weight. The most preferred surfactant is ethoxylated nonylphenol having an ethylene oxide content of about 30 moles present in the composition in an amount of about 0.6% by weight. Surfactants of the type described are generally commercially available dissolved in an aromatic hydrocarbon solvent such as toluene in an amount of about 12% by weight of the solution.

A variety of aqueous carrier liquids present in the range of from about 85 to about 97 percent by weight of the aqueous composition of this invention can be utilized herein. Examples of aqueous carrier liquids useful herein include acids, fresh water, brine and aqueous solutions containing chemicals useful for conducting other treatments in addition to the removal of deposits. In this regard, in the performance of production stimulation treatments in subterranean oil and gas producing formations, e.g., fracturing and/or acidizing the formations to increase the permeability thereof, the aqueous composition of the present invention can be utilized so that deposits contained on the formation surfaces and in tubular goods are removed while the stimulation treatment is carried out.

Further, as mentioned above, the composition of this invention can include an acid or a mixture of acids to remove various inorganic scale deposits. Often, such inorganic scale deposits are coated with organic deposits and are not readily removable by acid solutions alone. The compositions of the present invention containing as the aqueous carrier liquid one or more acids remove the organic deposits followed by the removal of inorganic deposits by acid reaction therewith. While a variety of acids can be utilized in the aqueous compositions, hydrochloric acid, acetic acid, formic acid, citric acid, hydrofluoric acid and mixtures of two or more of such acids are preferred. Various concentrations of such acids can be used depending upon the amount of inorganic scale to be removed and other factors.

A specific preferred aqueous composition of the present invention for removing asphaltenic and paraffinic containing deposits from surfaces is comprised of about 91.15% by weight of water, a hydrocarbon solvent selected from the group consisting of toluene, xylene and both toluene and xylene present in the composition in an amount of about 8% by weight, ethylenediamine present in the composition in an amount of about 0.25% by weight and ethoxylated nonylphenol having an ethylene oxide content of about 30 moles present in the composition in an amount of about 0.6% by weight.

Another preferred composition of this invention is comprised of about 90.95 percent by weight water, toluene present in the composition in an amount of about 4% by weight, xylene present in the composition in an amount of about 4.2% by weight, ethylenediamine present in the composition in an amount of about 0.25% by weight and ethoxylated nonylphenol having an ethylene oxide content of about 30 moles present in the composition in an amount of about 0.6% by weight.

In preparing the compositions, the surfactant, preferably dissolved in toluene or xylene, is first added to the aqueous carrier fluid while the carrier fluid is being agitated. Any additional hydrocarbon solvent or hydrocarbon solvents utilized are next slowly added to the mixture while it is being agitated followed by the addition of the amine utilized. The aqueous composition is agitated to homogeneously disperse the hydrocarbon solvent, amine and surfactant in the aqueous carrier fluid. If acid is to be included in the composition, a corrosion inhibitor, if used, is added to the composition after the addition of the amine followed by addition of the acid while continuously agitating the composition.

In carrying out the method of the invention, the composition is circulated over or otherwise brought into contact with the surface or surfaces from which deposits are to be removed. The composition can be heated if desired, but it is normally utilized at ambient temperatures. As the composition contacts the deposits, the asphaltenic and paraffinic constituents thereof are stripped from the surfaces in finely divided particles and suspended in the aqueous carrier fluid. As indicated above, if the deposits include inorganic scale constituents and one or more acids are included in the composition, the inorganic scale is simultaneously removed with the asphaltenic and paraffinic compounds.

As indicated above, solvents for paraffinic compounds comprised of a liquid mixture of hydrocarbon and surfactant dispersed in an aqueous carrier and solvents for asphaltenic compounds comprised of an aromatic hydrocarbon and an amine have been utilized heretofore individually. The compositions of the present invention, which include minor quantities of a hydrocarbon solvent, an amine and a surfactant dispersed in a major quantity of an aqueous carrier, simultaneously remove both asphaltenic and paraffinic compounds, and are more effective in the removal of such compounds than the previously used solvents individually. The methods and compositions of the invention are also useful in removing oil base drilling fluids from well formations and related equipment and in industrial cleaning applications.

The following examples are presented to illustrate certain specific embodiments of the methods and compositions of this invention and are not to be considered as limiting the scope of the invention.

EXAMPLE 1

In the laboratory, twelve 8-ounce bottles are weighed. Six of the bottles are coated with an invert emulsion drilling fluid containing fatty acids, amines, oil soluble residual, calcium oxide, asphaltic resin, barium sulfate, sodium chloride, and diesel, and six are coated with an oil base drilling fluid containing asphaltic resin, asbestos, barium sulfate and diesel. The coated bottles are baked in an oven at 150° F. for approximately 24 hours after which the bottles are allowed to cool for several hours at room temperature. The bottles are then reweighed to determine the amount of drilling fluid contained in the bottles.

Six test compositions are prepared in the laboratory by mixing the components in the order and in the amounts given in Table I. Compositions 1, 4, 5 and 6 are within the scope of the present invention, and compositions 2 and 3 are representative of the prior art compositions used to remove paraffinic containing deposits.

TABLE I

TEST DEPOSIT REMOVAL COMPOSITIONS

| Component | Composition 1 (% by Weight) | Composition 2 (% by Weight) | Composition 3 (% by Weight) | Composition 4 (% by Weight) | Composition 5 (% by Weight) | Composition 6 (% by Weight) |
|---|---|---|---|---|---|---|
| Water Containing 15% by weight Hydrochloric Acid | 91.71 | 95.87 | 91.66 | 90.99 | 95.16 | 95.37 |
| Ethoxylated Nonylphenol with Ethylene Oxide Content of 30 Moles | 0.55 | 0.55 | 1.11 | 0.56 | 0.55 | 0.55 |
| Toluene | 3.62 | 3.58 | 7.23 | | | |
| Xylene | 3.91 | | | 8.24 | 4.08 | 3.87 |
| Ethylenediame | 0.21 | | | 0.21 | 0.21 | 0.21 |
| TOTAL | 100.00 | 100.00 | 100.00 | 100.00 | 100.00 | 100.00 |

100 mls. of each of the compositions shown in Table I are added to two of the coated bottles described above, one bottle containing invert emulsion drilling fluid and the other bottle containing oil base drilling fluid. The bottles are sealed, clamped into wrist action shakers and allowed to shake for one hour at room temperature. The test compositions are decanted off, and the bottles are rinsed with distilled water, placed in a vacuum oven to dry for several hours and then reweighed to determine the quantity of baked drilling fluid removed by the test compositions. The results of these tests are shown in Table II below.

TABLE II

COMPARISON OF DRILLING FLUID REMOVAL BY VARIOUS COMPOSITIONS

| Drilling Fluid | Test Composition Used | Percent Drilling Fluid Removed | Quantity of Drilling Fluid Removed Per Quantity of Composition (Lbs/Gal) |
|---|---|---|---|
| Invert Emulsion | 1 | 99.6 | 1.02[1] |
| Oil Base | 1 | 99.9 | 1.26[1] |
| Invert Emulsion | 2 | 76.8 | 0.82[2] |
| Oil Base | 2 | 46.5 | 0.40[2] |
| Invert Emulsion | 3 | 86.9 | 1.31[2] |
| Oil Base | 3 | 54.0 | 1.62[2] |
| Invert Emulsion | 4 | 95.3 | 2.40[1] |
| Oil Base | 4 | 99.9 | 4.64[1] |
| Invert Emulsion | 5 | 99.7 | 1.58[1] |
| Oil Base | 5 | 100.00 | 4.47[1] |
| Invert Emulsion | 6 | 99.3 | 2.26[1] |
| Oil Base | 6 | 99.9 | 3.95[1] |

[1]Drilling fluid almost completely removed from surfaces of bottle and dispersed in small particles in composition.
[2]Drilling fluid still adhered to sides and bottom of bottle and large particles are produced which are not well dispersed.

From Table II it can be seen that the compositions falling within the scope of this invention (Compositions 1, 4, 5, and 6), are much more efficient in removing invert emulsion and oil base drilling fluids than Compositions 2 and 3 comprised of an aromatic hydrocarbon and ethoxylated nonylphenol surfactant dispersed in an aqueous carrier fluid containing hydrochloric acid.

EXAMPLE 2

In the laboratory three 8-ounce bottles are weighed and then coated with a simple material derived from crude oil containing 3.4% by weight paraffinic compounds, 38.5% by weight asphaltenic compounds and inorganic material comprised of quartz, clays, calcite, feldspar and kaolinite. The softening point of the material is 135° F. and the bottles are coated in a hot oil bath. After coating, the bottles are cooled for several hours at room temperature and then reweighed to determine the amount of sample material contained in the bottles.

100 mls. of the compositions shown in Table III below are added to separate bottles after which the bottles are sealed and clamped into wrist action shakers. The bottles are allowed to shake for 30 minutes at room temperature after which the test compositions are decanted off. The bottles are rinsed with distilled water, placed in a vacuum oven to dry for several hours and then reweighed to determine the amount of sample material removed by each composition. The results of these tests are shown in Table IV below.

TABLE III

TEST DEPOSIT REMOVAL COMPOSITIONS

| Component | Composition 1 (% by Weight) | Composition 2 (% by Weight) | Composition 3 (% by Weight) |
|---|---|---|---|
| Water | 95.57 | 91.14 | |
| Ethoxylated Nonylphenyl with Ethylene Oxide Content of 30 Moles | 0.59 | 0.59 | |
| Toluene | 3.84 | 3.86 | |
| Xylene | | 4.18 | 93.79 |
| Ethylene-diamine | | 0.23 | 5.12 |
| Aromatic sulfonate | | | 1.09 |
| TOTAL | 100.00 | 100.00 | 100.00 |

TABLE IV

COMPARISION OF PARAFFINIC AND ASPHALTENIC CONTAINING DEPOSIT REMOVAL BY VARIOUS COMPOSITIONS

| Test Composition Used | Percent of Deposit Removed | Quantity of Deposit Removed Per Quantity of Composition (Lbs/Gal) |
|---|---|---|
| 1 | 57.7 | 0.5[2] |
| 2 | 93.2 | 0.85[1] |
| 3 | 79.2 | 0.90[2] |

[1]Within 5 minutes sample material almost completely removed from surfaces of bottle and dispersed in small particles in composition.
[2]Sample material still adhered to surfaces of bottle after 30 minutes and large particles are produced which are not well dispersed.

From Table IV it can be seen that the composition of this invention (Composition 2) is considerably more effective in removing paraffinic and asphaltenic containing deposits from surfaces than prior art compositions, i.e., a composition containing water, an aromatic hydrocarbon and a surfactant (Composition 1), or a composition containing an aromatic hydrocarbon and an amine (Composition 3).

EXAMPLE 3

In the laboratory, equal amounts of a solidified sample material derived from crude oil containing 1.5% by weight paraffinic compounds, 4.2% by weight asphaltenic compounds and inorganic materials including small amounts of quartz, calcite, sodium chloride and troilite are placed in two beakers. 100 mls. of the test compositions shown in Table V below are placed in the beakers and allowed to react with the sample material contained therein for 4 hours while being visually observed.

TABLE V

TEST DEPOSIT REMOVAL COMPOSITIONS

| Component | Composition 1 (% by Weight) | Composition 2 (% by Weight) |
|---|---|---|
| Water Containing 15% by Weight Hydrochloric Acid, 0.99% by Weight Acetic Acid and 0.56% by Weight Citric Acid | 91.71 | 95.87 |
| Ethoxylated Nonylphenol With Ethylene Oxide Content of 30 Moles | 0.55 | .55 |

TABLE V-continued

TEST DEPOSIT REMOVAL COMPOSITIONS

| Component | Composition 1 (% by Weight) | Composition 2 (% by Weight) |
|---|---|---|
| Toluene | 3.62 | 3.58 |
| Xylene | 3.91 | |
| Ethylenediamine | .21 | |
| TOTAL | 100.00 | 100.00 |

The visual observation of the beakers indicates that the composition of the present invention (Composition 1) very quickly disperses organic material and attacks and dissolves inorganic material contained in the sample. This is contrasted with Composition 2 which disperses the organic material and attacks the inorganic material at a much slower rate.

EXAMPLE 4

Two 8-ounce bottles are weighed and then coated with a sample material derived from a crude oil by placing the sample in the bottle and placing the bottle in a hot oil bath with enough time allowed for the sample to melt. The sample material contains 51.4% by weight paraffinic compounds, 1.4% by weight high molecular weight asphaltenic and paraffinic compounds and 1.9% by weight inorganic materials. The bottles are cooled for several hours at room temperature after which they are reweighed to determine the quantities of sample material contained therein.

Composition 1 shown in Table VI below is prepared and the pH determined to be 11.1. Composition 2 is prepared without the ammonium hydroxide, and the pH is determined to be 4.9. The pH of Composition 2 is then buffered up to a pH of 11.1 by the addition of 2 cc of ammonium hydroxide thereto. Composition 1 is added to one of the bottles and Composition 2 is added to the other bottle after which the bottles are sealed and clamped into wrist action shakers. The bottles are allowed to shake for one hour at room temperature after which the compositions are decanted off. The bottles are rinsed with distilled water, placed in a vacuum oven to dry for several hours and then reweighed to determine the amount of sample material removed by the compositions. The results of these tests are shown in Table VII below.

TABLE VI

TEST DEPOSIT REMOVAL COMPOSITIONS

| Composition | Composition 1 (% by weight) | Composition 2 (% by weight) |
|---|---|---|
| Water | 91.14 | 89.72 |
| Ethoxylated Nonylphenol With Ethylene Oxide Content of 30 Moles | 0.59 | 0.58 |
| Toluene | 3.86 | 3.80 |
| Xylene | 4.18 | 4.11 |
| Ethylenediamine | 0.23 | |
| Ammonium Hydroxide | | 1.79 |
| TOTAL | 100.00 | 100.00 |

TABLE VII

COMPARISION OF PARAFFINIC AND ASPHALTENIC CONTAINING DEPOSIT REMOVAL BY VARIOUS COMPOSITIONS

| Test Composition Used | Percent of Deposit Removed | Quantity of Deposit Removed Per Quantity of Composition (Lbs/Gal) |
|---|---|---|
| 1 | 93.5 | 0.94[1] |

TABLE VII-continued

COMPARISION OF PARAFFINIC AND ASPHALTENIC CONTAINING DEPOSIT REMOVAL BY VARIOUS COMPOSITIONS

| Test Composition Used | Percent of Deposit Removed | Quantity of Deposit Removed Per Quantity of Composition (Lbs/Gal) |
|---|---|---|
| 2 | 85.4 | 0.82[2] |

[1]Sample material almost completely removed from surfaces of bottle and dispersed in samll particles in composition.

[2]Sample material still adhered to surfaces of bottle and large particles are produced which are not well dispersed.

As can be seen from Table VII, the composition of the present invention (Composition 1) more effectively removes deposits from surfaces than does a similar composition having an ammonium hydroxide component substituted for the amine component (Composition 2).

EXAMPLE 5

Three 8-ounce bottles are weighed and then coated with a sample material derived from a crude oil and thereafter baked in an oven for an extended period of time. The sample material contains 3.9% by weight paraffinic compounds, 1% by weight asphaltenic compounds, and 13.9% by weight inorganic materials. The inorganic materials in the sample include barite, magnetite, hematite, sodium chloride, quartz, feldspars, calcite and siderite. After coating, the bottles are cooled for several hours at room temperature and then reweighed to determine the amount of sample material contained in the bottles.

100 mls. of the compositions set forth in Table VIII below are added to separate bottles after which the bottles are sealed and clamped into wrist action shakers. The bottles are allowed to shake for 90 minutes at room temperature after which the test compositions are decanted off. The bottles are rinsed with distilled water, placed in a vacuum oven to dry for several hours, and then reweighed to determine the amount of sample material removed by each composition. The results of these tests are shown in Table IX below.

TABLE VIII

TEST DEPOSIT REMOVAL COMPOSITIONS

| Component | Composition 1(% By Weight) | Composition 2 (% By Weight) | Composition 3 (% By Weight) |
|---|---|---|---|
| Water Containing 15% By Weight Hydrochloric Acid, 0.99% by Weight Acetic Acid and 0.56% by Weight Citric Acid | 91.71 | 95.87 | |
| Ethoxylated Nonylphenol with Ethylene Oxide Content of 30 Moles | 0.55 | 0.55 | |
| Toluene | 3.62 | 3.58 | |
| Xylene | 3.91 | | 98.91 |
| Ethylenediamine | 0.21 | | |
| Aromatic Sulfonate | | | 1.09 |
| TOTAL | 100.00 | 100.00 | 100.00 |

TABLE IX

COMPARISON OF PARAFFINIC AND ASPHASLTENIC CONTAINING DEPOSIT REMOVAL BY VARIOUS COMPOSITONS

| Test Composition Used | Percent of Deposit Removed | Quantity of Deposit Removed Per Quantity of Composition (Lbs/Gal) |
|---|---|---|
| 1 | 98.6 | 2.10[1] |
| 2 | 60.6 | 1.06[2] |
| 3 | 34.6 | 0.57[3] |

[1]Sample material almost completely removed from surfaces of bottles and dispersed in small particles in composition.

[2]Sample material still adhered to surfaces of bottle and large particles are produced which are not well dispersed.

[3]Sample material still adhered to sides and bottom of bottle and very little of sample material removed.

This invention is not limited to the above described specific embodiments thereof; it must be understood therefore that the detail involved in the descriptions of the specific embodiments is presented for the purpose of illustration only, and that reasonable variations and modification, which will be apparent to those skilled in the art, can be made in this invention without departing from the spirit or scope thereof.

Having thus described the invention, that which is claimed is:

What is claimed is:

1. A one-step method for removing asphaltenic and paraffinic containing deposits from surfaces comprising contacting said deposits with an aqueous composition containing essentially of:

an aqueous carrier liquid present in said composition in an amount in the range of from about 85% to about 97% by weight;

a hydrocarbon solvent which is dispersed in said aqueous carrier liquid in an amount in the range of from about 3% to about 9% by weight of said composition wherein said hydrocarbon solvent is selected from the group consisting of benzene, xylene, toluene, naphtha, kerosene and mixtures thereof, a base selected from the group consisting of ammonium hydroxide, organic bases and mixtures thereof wherein said organic bases are selected from the group consisting of pyridine, morpholine, and primary, secondary and tertiary amines defined by the general formula:

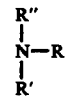

wherein R, R' and R'' represent members selected from the group consisting of hydrogen, alkyl radicals having 1 to 4 carbon atoms, alkylamine radicals having from 1 to 4 carbon atoms, cycloalkyl radicals having 3 to 6 carbon atoms and mixtures thereof, said base being dispersed in said aqueous carrier liquid in an amount in the range of from about 0.44% to about 2.5% by weight of said composition; and a surfactant having the general formula:

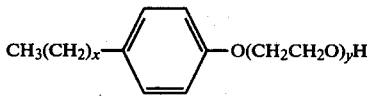

wherein x has a value ranging from about 2 to about 11 and y has a value ranging from about 10 to about 40 and mixtures thereof, said surfactant being dispersed in said aqueous carrier liquid in an amount in the range of from about 0.44% to about 4% by weight of said composition.

2. The method of claim 1 wherein said base is selected from the group consisting of pyridine, morpholine, diethylaminopropylamine, diethylamine, n-butyl amine, dimethylaminopropylamine, ethylenediamine, diethylenetriamine and mixtures thereof, and is present in said composition in an amount in the range of from about 0.1% to about 0.5% by weight.

3. The method of claim 2 wherein said surfactant is selected from the group consisting of ethoxylated nonylphenol having an ethylene oxide content in the range of from about 10 moles to about 40 moles and ethoxylated octylphenol having an ethylene oxide content in the range of from about 10 moles to about 40 moles and mixtures thereof and is present in said composition in an amount in the range of from about 0.2% to about 1.5% by weight.

4. The method of claim 1 wherein said hydrocarbon solvent is selected from the group consisting of benzene, xylene, toluene and mixtures thereof and is present in said composition in an amount in the range of from about 7% to about 8.5% by weight.

5. The method of claim 4 wherein said base is ethylenediamine and is present in said composition in an amount of about 0.25% by weight.

6. The method of claim 5 wherein said surfactant is ethoxylated nonylphenol having an ethylene oxide content of about 30 moles and is present in said composition in an amount of about 0.6% by weight.

7. The method of claim 1 wherein said aqueous carrier liquid is an acid selected from the group consisting of hydrochloric acid, acetic acid, formic acid, citric acid, hydrofluoric acid and mixtures of two or more of such acids.

8. A one-step method for removing asphaltenic and paraffinic containing deposits from surfaces comprising contacting said deposits with an aqueous composition consisting essentially of about 91.15% by weight of an aqueous carrier liquid, a hydrocarbon solvent selected from the group consisting of benzene, toluene, xylene and mixtures thereof present in said composition in an amount of about 8% by weight, ethylenediamine present in said composition in an amount of about 0.25% by weight and ethoxylated nonylphenol having an ethylene oxide content of about 30 moles present in said composition in an amount of about 0.6% by weight.

9. The method of claim 8 wherein said hydrocarbon solvent includes at least toluene present in said composition in an amount of about 3% by weight.

10. The method of claim 9 wherein said aqueous carrier liquid is an acid selected from the group consisting of hydrochloric acid, acetic acid, formic acid, citric acid, hydrofluoric acid and mixtures thereof.

11. The method of claim 8 wherein said aqueous carrier liquid is water.

12. An aqueous composition for removing asphaltenic and paraffinic containing deposits from surfaces comprising an aqueous acidic carrier liquid present in said composition in an amount in the range of from about 85% to about 97% by weight wherein the acid is selected from the group consisting of hydrochloric acid, acetic acid, formic acid, citric acid, hydrofluoric acid and mixtures of two or more of such acids;

a hydrocarbon solvent which is dispersed in said aqueous carrier liquid in an amount in the range of from about 3% to about 9% by weight of said composition wherein said hydrocarbon solvent is selected from the group consisting of benzene, xylene, toluene, naphtha, kerosene and mixtures thereof;

a base selected from the group consisting of ammonium hydroxide, organic bases and mixtures thereof wherein said organic bases are selected from the group consisting of pyridine, morpholine, and primary, secondary and tertiary amines defined by the general formula:

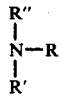

wherein R, R′ and R″ represent members selected from the group consisting of hydrogen, alkyl radicals having 1 to 4 carbon atoms, alkylamine radicals having from 1 to 4 carbon atoms, cycloalkyl radicals having 3 to 6 carbon atoms and mixtures thereof, said base being dispersed in said aqueous carrier liquid in an amount in the range of from about 0.04% to about 2.5% by weight of said composition; and a surfactant having the general formula:

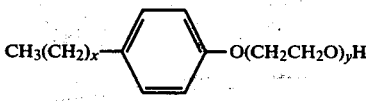

wherein x has a value ranging from about 2 to about 11 and y has a value ranging from about 10 to about 40 and mixtures thereof, said surfactant being dispersed in said aqueous carrier liquid in an amount in the range of from about 0.04% to about 4% by weight of said composition.

13. The composition of claim 12 wherein said base is selected from the group consisting of pyridine, morpholine, diethylaminopropylamine, diethylamine, n-butyl amine, dimethylaminopropylamine, ethylenediamine, diethylenetriamine and mixtures thereof, and is present in said composition in an amount in the range of from about 0.1% to about 0.5% by weight.

14. The composition of claim 13 wherein said surfactant is selected from the group consisting of ethoxylated nonylphenol having an ethylene oxide content in the range of from about 10 moles to about 40 moles and ethoxylated octylphenol having an ethylene oxide content in the range of from about 10 moles to about 40 moles and mixtures thereof and is present in said composition in an amount in the range of from about 0.2% to about 1.5% by weight.

15. The composition of claim 12 wherein said hydrocarbon solvent is selected from the group consisting of benzene, xylene, toluene and mixtures thereof and is present in said composition in an amount in the range of from about 7% to about 8.5% by weight.

16. The composition of claim 15 wherein said base is ethylenediamine and is present in said composition in an amount of about 0.25% by weight.

17. The composition of claim 16 wherein said surfactant is ethoxylated nonylphenol having an ethylene oxide content of about 30 moles and is present in said composition in an amount of about 0.6% by weight.

18. An aqueous composition for removing asphaltenic and paraffinic containing deposits from surfaces comprising an aqueous acidic carrier liquid, in an amount of about 91.15% by weight, wherein the acid is selected from the group consisting of hydrochloric acid, acetic acid, formic acid, citric acid, hydrofluoric acid and mixtures thereof, a hydrocarbon solvent selected from the group consisting of benzene, toluene, xylene and mixtures thereof present in said composition in an amount of about 8% by weight, ethylenediamine present in said composition in an amount of about 0.25% by weight and ethoxylated nonylphenol having an ethylene oxide content of about 30 moles percent in said composition in an amount of about 0.6% by weight.

19. The composition of claim 18 wherein said hydrocarbon solvent includes at least toluene present in said composition in an amount of about 3% by weight.

* * * * *

UNITED STATES PATENT AND TRADEMARK OFFICE

CERTIFICATE OF CORRECTION

PATENT NO. : 4,207,193

DATED : June 10, 1980

INVENTOR(S) : WILLIAM G. F. FORD and TOMMY R. GARDNER

It is certified that error appears in the above–identified patent and that said Letters Patent are hereby corrected as shown below:

At Column 1, in line 48, delete [wall] and insert --well--.

At Column 10, Claim 1, in line 33, delete [containing] and insert --consisting--.

At Column 10, Claim 1, in line 66, delete [0.44%] and insert --.04%--.

At Column 11, Claim 1, in line 12, delete [0.44%] and insert --.04%--.

At Column 14, Claim 18, in line 10, delete [percent] and insert --present--.

Signed and Sealed this

*Nineteenth* Day of *August 1980*

[SEAL]

*Attest:*

SIDNEY A. DIAMOND

*Attesting Officer*

*Commissioner of Patents and Trademarks*